United States Patent [19]

Kahng

[11] 3,930,271

[45] Jan. 6, 1976

[54] GOLF GLOVE

[75] Inventor: He Chung Kahng, Glenview, Ill.

[73] Assignee: Hi-Kahng Trading Co., Chicago, Ill.

[22] Filed: Dec. 16, 1974

[21] Appl. No.: 532,875

[52] U.S. Cl. ..... 2/161 A; 2/21

[51] Int. Cl.[2] ..... A41D 19/00

[58] Field of Search ..... 2/16, 20, 21, 159, 161 R, 2/161 A, 163; 294/25

[56] References Cited

UNITED STATES PATENTS 2,379,430 7/1945 Frost ..... 2/161 A 2,782,422 2/1957 Bencriscutto ..... 2/161 A

*Primary Examiner*—Geo. V. Larkin

*Attorney, Agent, or Firm*—Baker & McKenzie

[57] ABSTRACT

A golf glove is disclosed having an extra finger pocket between the index and middle finger pockets for securing one finger of one hand of a golf player between the fingers of the player's other hand.

4 Claims, 6 Drawing Figures

GOLF GLOVE

BACKGROUND OF THE INVENTION

1. Field of the Invention

This invention relates to a device designed to improve a golfer's grip on a golf club, and more particularly, to a device to assist a golfer in maintaining the proper position of the fingers of one hand with respect to the other hand on the club during the entire swing of the golf club.

2. Description of the Prior Art

From the prior art, a number of glove configurations and other devices are known for improving a player's grip on a golf club or to assure the proper positioning of the player's hands on the golf club. Such include gloves with special attachments for holding a player's fingers in position with respect to the palm of the hand, and gloves having straps adapted to fit around a golf club or to fit around the thumb of a player's opposite hand. One prior art device comprises a two-handed glove to force the two hands of a player to remain in a fixed position relative to each other.

As is well-known, a golfer adjusts his grip on the golf club and aligns the head of the golf club with the ball, while holding the club in front of himself. In aligning the head of the club with the ball, the player turns the club such that the face of the club's head is at the proper angle relative to the ball. It has become apparent, however, that during the swing, a player has a tendency to twist the club somewhat changing the carefully adjusted angle of the head relative to the ball. While a player may have a firm grip on the club while starting the back swing, as for example in an overlapping grip, there is a tendency for the fingers of the right hand of a right-handed player to move away from the fingers of the left and just prior to beginning the down swing in preparation for hitting the ball. Such loosening of the grip has a tendency to cause the club to twist, causing a change in the angle of the face of the club's head when it comes in contact with the ball.

Prior art gloves which are directed to maintaining a strong grip by means of the left hand do not aid in maintaining a proper position of the fingers of the right hand on the club. Certain prior art devices such as the two-handed glove mentioned above, or another known device consisting of a relatively thin sheet of flexible material which fits around the glove and having holes through which fingers of both hands are extended, are intended to fix the position of the fingers of both hands. They are, at best, awkward to use or difficult to manufacture, or both.

SUMMARY OF THE INVENTION

In accordance with this invention, a modified golfing glove is provided for improving a golfer's grip on a club, having a receptacle or restraining surface for holding one or more digits of one hand in a secured position relative to the digits of the other hand. In one illustrative embodiment of this invention, a standard golf glove is modified by the addition of a finger receptacle or finger pocket extending in a direction opposite the direction of the normal finger receptacles or pockets of the glove, and attached adjacent to the middle finger and index finger pockets of the glove. In a so-called overlapping grip, the little finger of the right hand of a right-handed golfer, may fit into the extra pocket. When so positioned, the little finger of the right hand will tend to remain securely nestled between the middle and index fingers of the left hand during the entire swing, avoiding an unwanted twisting of the club during the swing. In an alternative embodiment of the invention, several straps are extended between the middle and index finger pockets of a golf glove of one hand to provide a pocket for the little finger of the other hand.

In yet another embodiment of my invention, a loop resembling a section of a finger pocket is attached to the outer edge of the index finger pocket of the glove of one hand to accommodate the ring finger of the player's other hand.

DETAILED DESCRIPTION

Figure 1:
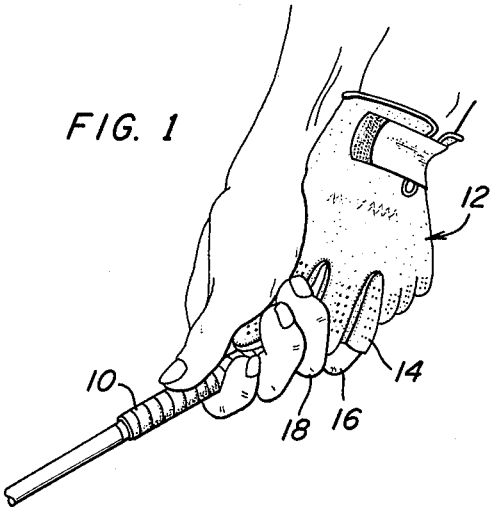
FIG. 1 is a perspective view of a portion of a golf club handle being gripped in an overlapping grip.

The figures as outlined above, refer to a left-handed golf glove to be worn by a right-handed player. The invention is clearly adaptable to use by left-handed players using a right-handed glove having the features of this invention as shown in the drawing and described herein.

FIG. 1 shows the two hands of a player gripping the handle 10 of a club in the so-called overlapping grip. The player's left hand is in a glove 12 having an extra pocket 14 attached to the glove between the middle and index fingers. The pocket 14 points in the direction opposite of the other finger pockets of the glove, and as shown in FIG. 1, the little finger 16 of the player's left hand is extended into the pocket 14.

Figure 2:
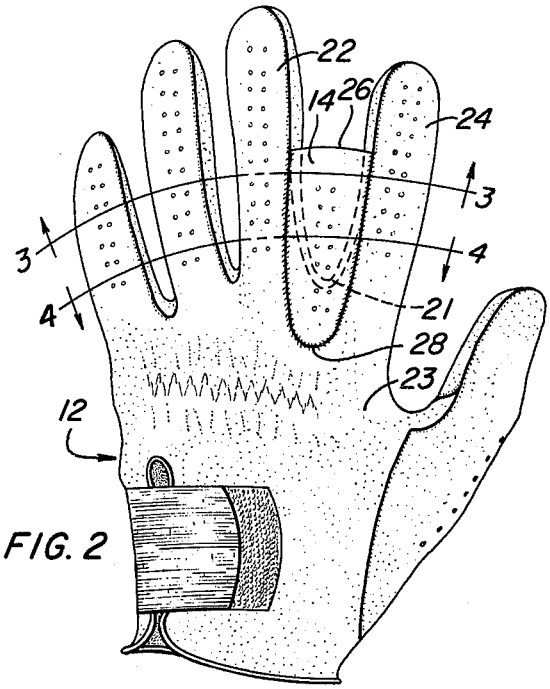
FIG. 2 is a plan view of a left-handed golf glove having a finger pocket for accommodating one of the fingers of the right hand.
Figure 3:
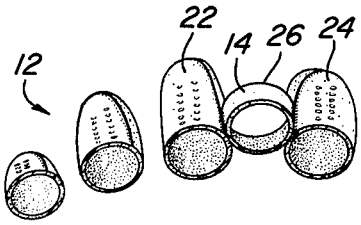
FIGS. 3 and 4 are perspective views taken substantially along the sectional lines 3—3 and 4—4, respectively, of FIG. 1.
Figure 4:
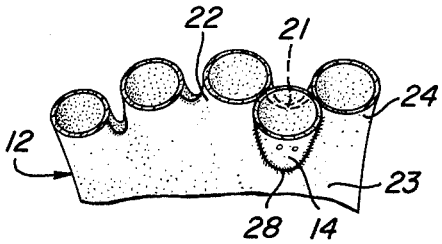

FIG. 2 is a plan view of a left-handed glove such as shown in FIG. 1. The extra finger pocket 14 is shown to be positioned partially between and extending partially over the middle and index finger pockets 22 and 24. The upper edge 26 of the pocket 14 preferably terminates in the vicinity of the position of the outer-most knuckle of the left index finger when the same is inserted in the index finger pocket 24. The fingertip end 28 of the pocket 14, preferably extends a distance beyond the common termination point 21 of middle and index finger pockets 22 and 24. The length of the finger pockets 14 will preferably be approximately equal to the distance from the middle knuckle to the tip of the little finger of the right hand of a player. As shown in the perspective representation of FIG. 3 and FIG. 4, the open end 26 of the extra pocket 14 is positioned partially between the middle and index finger pockets 22 and 24. The end portion 28 extends beyond the common termination point 21 of the finger pockets 22 and 24 and is fastened to the back section 23 of the glove. The extra finger pocket may be attached to the back of the glove and its adjoining finger pockets by stitching or another known method.

It will be understood that when a right-handed player grips the golf club in an overlapping grip, as represented in FIG. 1, the little finger 16 will extend into the extra pocket 14. Thus, the end of the little finger of the right hand, when inserted in the pocket in this manner, will rest on the area on the back of the left hand between the knuckles of the middle and index fingers. When the little finger is inserted in the extra pocket and positioned in the manner described, the player's hands are interlocked in such a manner as to keep the left hand in position relative to the right hand. Particularly, the right hand does not have the tendency to open during any part of the swing, and loss of the correct grip is avoided.

Figure 5:
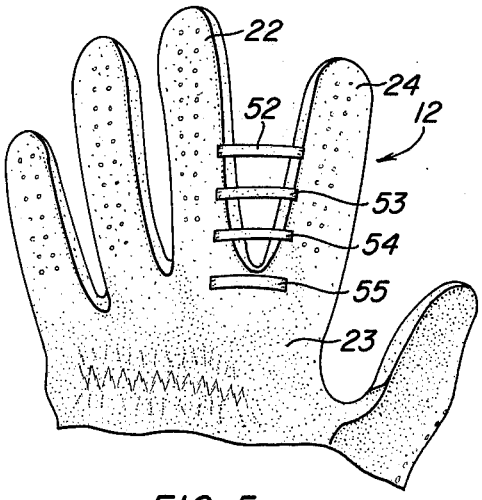
FIG. 5 is a plan view of a left-handed glove having straps extending between two finger pockets thereof to accommodate a finger of the right hand.

As is apparent from the above description and the drawing, the finger pocket 14 overlays the back panel 23 of the glove. When this finger pocket 14 is attached to the glove by means of peripheral stitching as indicated in the drawing, it is possible for a player to place the little finger of the right hand underneath the pocket 14. In this manner, the lower surface of the finger pocket acts as a restraining surface and the end portion of the little finger of the right hand fits snugly underneath the end portion 28 of the finger pocket 14. When the little finger is so positioned, the player has a sense of interlocking of hands in the same manner as when the little finger is inserted in the pocket. The function of restraining the little finger of the right hand in the desired position between the middle and index fingers and overlapping the back of the left hand, may also be accomplished by means of a plurality of straps extending between the middle and index finger pockets and one or more straps attached to the back of the glove. Such an arrangement is shown in FIG. 5. The straps 52, 53 and 54 extend between the middle finger pocket 22 and the index finger pocket 24 and are attached thereto. The strap 55 is attached to the back panel 23 of the glove 12. It will be understood that when the glove of FIG. 5 is worn by a player and a golf club is gripped in the manner depicted in FIG. 1, the little finger 16 of the player's right hand will fit underneath and be restrained by, the straps 52 through 55. When used in this manner, a glove having such straps aids the player to maintain a secure grip on the golf club.

Figure 6:
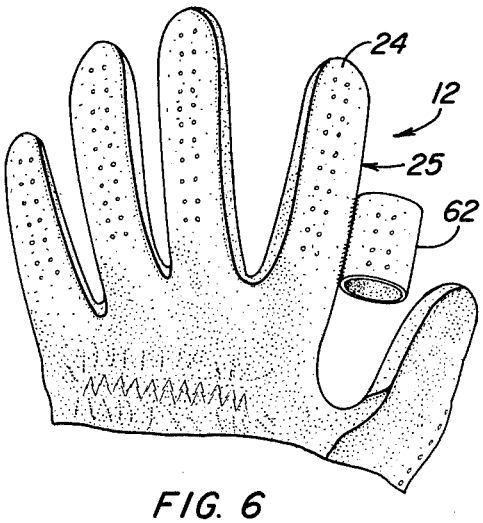
FIG. 6 is a plan view of a left-handed glove having a section of a finger pocket attached to the outer edge of the index finger pocket to accommodate a finger from the right hand.

As stated earlier herein, there is a tendency for the overlapping hand, for example the right hand shown in FIG. 1, to open slightly when the club is raised in preparation for the swing, which may result in an inadvertent turning of the club. This tendency of a player's hand to open is reduced substantially be interlocking the little finger of that hand between the middle and index fingers of the other hand in the manner described in the previous paragraphs. The same effect may be obtained by securing one of the other fingers of the overlapping hand, for example the ring finger. FIG. 6 shows a finger receptacle 62 attached to the outer edge 25 of the index finger pocket 24 of a left-handed glove. The receptacle 62 may be attached to the pocket by means of stitching or any other known means. When a golf club 10 is gripped by means of the overlapping grip as depicted in FIG. 1, the ring finger 18 of the right hand may be inserted into the receptacle 62. When the ring finger of the right hand is inserted in the receptacle 62 in the manner described, the tendency of the right hand to open during the swing is reduced substantially, aiding the golfer in maintaining the correct alignment of the club. When using a grip other than the overlapping grip depicted in FIG. 1, a golfer may insert another digit, for example, the little finger of the left hand, in the receptacle 62.

While the invention has been illustrated by means of the examples described above and shown in the drawing, it will be apparent to those skilled in the art that other embodiments may be produced without departing from the scope of the present invention.

What I claim is:

1. A golf glove comprising at least an index finger receptacle, a middle finger receptacle and a back surface extending from said receptacles in the direction of the wrist, and further comprising another finger receptacle disposed adjacent said index finger receptacle and said middle finger receptacle and overlapping a portion of said back section.

2. A golf glove in accordance with claim 1 wherein said other finger receptacle is attached along its periphery to said index finger receptacle, said middle finger receptacle and said back surface.

3. A glove comprising an index finger receptacle, a middle finger receptacle, a back surface extending in the direction of the wrist, a finger restraining strap extending between said receptacles, and a finger restraining strap attached to said back surface adjacent said index finger receptacle and said middle finger receptacle and aligned in a direction substantially parallel to said finger restraining strap extending between said finger receptacles.

4. A golf glove adapted for use on one hand of a golf player comprising at least an index finger receptacle and further comprising a finger receptacle attached to the side of said index finger receptacle most nearly adjacent to the thumb and adapted to receive a finger of the golf player's other hand.

* * * * *